US010260246B2

(12) United States Patent
Borys

(10) Patent No.: US 10,260,246 B2
(45) Date of Patent: Apr. 16, 2019

(54) METHOD OF REPAIRING AND IMPROVING HERMETICALLY SEALED INSULATED GLASS UNITS IN CURTAIN WALL SYSTEMS OF OLDER BUILDINGS

(71) Applicant: Ryszard M. Borys, Edgerton, WI (US)

(72) Inventor: Ryszard M. Borys, Edgerton, WI (US)

( * ) Notice: Subject to any disclaimer, the term of this patent is extended or adjusted under 35 U.S.C. 154(b) by 0 days.

(21) Appl. No.: 15/939,854

(22) Filed: Mar. 29, 2018

(65) Prior Publication Data

US 2018/0313100 A1 Nov. 1, 2018

Related U.S. Application Data

(60) Provisional application No. 62/602,527, filed on Apr. 26, 2017.

(51) Int. Cl.

| | |
|---|---|
| ***E04G 23/00*** | (2006.01) |
| ***E04G 23/02*** | (2006.01) |
| ***E06B 3/673*** | (2006.01) |
| ***E04B 2/96*** | (2006.01) |
| ***E06B 3/677*** | (2006.01) |
| ***E06B 3/67*** | (2006.01) |
| ***E06B 3/66*** | (2006.01) |
| ***E06B 3/54*** | (2006.01) |

(52) U.S. Cl.

CPC ..... *E04G 23/02* (2013.01); *E04B 2/96* (2013.01); *E06B 3/5418* (2013.01); *E06B 3/6608* (2013.01); *E06B 3/6715* (2013.01); *E06B 3/6775* (2013.01); *E06B 3/67326* (2013.01)

(58) Field of Classification Search

CPC .... E06B 3/5418; E06B 3/6775; E06B 3/6715; E06B 3/6608; E06B 3/67326; E04B 2/96

See application file for complete search history.

(56) References Cited

U.S. PATENT DOCUMENTS

| | | | | |
|---|---|---|---|---|
| 5,412,922 | A * | 5/1995 | Vittori | E04G 23/02 52/745.16 |
| 6,804,924 | B2 * | 10/2004 | Zurn | E06B 3/677 52/204.52 |
| 7,763,334 | B2 * | 7/2010 | Berkowitz | E06B 3/5418 428/34 |
| 9,441,415 | B2 | 9/2016 | Dear | |
| 2015/0074968 | A1 * | 3/2015 | Mader | E06B 3/6733 29/426.2 |

* cited by examiner

*Primary Examiner* — Patrick J Maestri

(74) *Attorney, Agent, or Firm* — Ziolkowski Patent Solutions Group, SC

(57) ABSTRACT

A method for repairing or upgrading of existing insulated glass units already installed into a window framing or curtain wall system is provided. The method includes removing an inside glass stop from a window framing housing the insulated glass unit to provide access to an inner glass panel and detaching the inner glass panel from an outer glass panel via a breaking or altering of the separator, with the outer glass panel being retained in place within the window framing. The method also includes applying a new separator to the inner glass panel and/or the outer glass panel, reaffixing the inner glass panel to the outer glass panel while maintaining a space between the inner glass panel and the outer glass panel to form a hermetically sealed cavity therebetween, and reinstalling the inside glass stop back onto the window framing, to secure the inner glass panel in place.

20 Claims, 3 Drawing Sheets

METHOD OF REPAIRING AND IMPROVING HERMETICALLY SEALED INSULATED GLASS UNITS IN CURTAIN WALL SYSTEMS OF OLDER BUILDINGS

CROSS-REFERENCE TO RELATED APPLICATION

The present application is a non-provisional of, and claims priority to, U.S. Provisional Patent Application Ser. No. 62/602,527, filed Apr. 26, 2017, the disclosure of which is incorporated herein by reference in its entirety.

BACKGROUND OF THE INVENTION

Embodiments of the invention relate generally to insulated glass units and, more particularly, to a method for repairing, renewing, or upgrading failing hermetically sealed insulated glass units.

Insulated glass units (also known as double-glazed or double-paned window units) are window units that are commonly used in curtain wall systems of occupied office or residential high-rise buildings or other similar high-rise structures to provide energy efficient and aesthetically pleasing window structures. Insulated glass units are formed generally of a pair of glass panes that are generally parallel to one another and that have a spacer running between them at their peripheries. Spacers, commonly of metal or other suitable components, are adhered by means of a sealant to the glass panes, the sealant desirably forming a gas-tight seal to thus prevent moisture or gas from entering or leaving the space between the panes, with argon or another gas that has a coefficient of thermal conductivity less than that of air commonly filling the space to improve the insulating capacity of the insulated glass unit. Commonly, the between-pane space is filled with gas to a pressure that is approximately atmospheric, although pressure adjustments may be made in connection with the elevation of the geographic locale where the insulated glass unit is to be installed. The sealed gas filled space between the panes thus provides an insulating layer that reduces heat transfer across the unit.

It is recognized that, over a period of time moisture will slowly infiltrate in to the inner cavity or gas/argon may slowly leak from the between-pane space of the insulated glass unit to the atmosphere. This occurs at a rate greater than the permeation of oxygen or nitrogen into the between-pane space, with the result that the pressure in the between-pane space is reduced below atmospheric pressure. The resulting pressure differential causes the panes to cup inwardly, and the panes can eventually touch near their centers, with consequent loss of insulating value. The moisture infiltration into the unit or the leaking of gas/argon from the between-pane space of the insulated glass unit can also cause the window unit to become cloudy from moisture infiltration between the two panes of glass, thereby causing distortion of vision.

When failure of an insulated glass unit occurs, the insulated glass unit necessarily has to be replaced, and this can be extremely expensive in that the failed insulated glass unit must be removed, replaced, and reinstalled on a unit-by-unit basis. In replacing insulated glass units that have failed, existing methods typically rip out the existing window unit and replace it with a new insulated glass unit. The primary disadvantage of this approach, other than cost, is that it opens the occupied building to weather elements and prevents a tenant from occupying the space while this replacement process takes place, and it is recognized that the expense of relocating the tenants, the disruption of operation of businesses, and the loss of rent will be extremely costly. In addition, there are demolition and disposal costs associated with the hundreds or thousands of pounds of glass and other materials of the window units that are being are removed and replaced with new window units. Still further, in the case of multi-level buildings, removal and replacement of the entire window unit is dangerous work, as the removal and replacement must be performed from the outside of the building. These drawbacks, together with the loss of tenancy, makes current techniques for removing and replacing insulated glass units an expensive operation.

It would therefore be desirable to provide a method for repairing/renewing existing insulated glass units, already installed in a building structure, where hermetic seal failure between the two or more panels of glass occurs or is predicted to soon occur. It would further be desirable for such a method to be performed without exposing the interior of the building to outside elements during the repair/renewal, with one panel of the existing unit being retained in the framing while the inside facing panel or panels are removed altogether along with the separating spacer elements.

BRIEF DESCRIPTION OF THE INVENTION

In accordance with one aspect of the invention, a method for repairing or upgrading a failing or insufficiently performing insulated glass unit comprising an inner glass panel or panels and an outer glass panel spaced apart by a separator or separators and being housed within a window framing or curtain wall system is provided. The method includes removing an inside glass stop from the window framing or curtain wall to provide access to the inner glass panel or panels and detaching the inner glass panel or panels from the outer glass panel via a breaking, cutting, or altering of the separator or separators, with the outer glass panel being retained in place within the window framing or curtain wall. The method also includes applying a new separator or separators to one of the inner glass panel or panels or the outer glass panel and reaffixing the inner glass panel or panels to the outer glass panel, with the new separator or separators maintaining a space or spaces between the inner glass panel or panels and the outer glass panel to form a hermetically sealed cavity or cavities there between. The method further includes reinstalling in place the inside glass stop back onto the window framing, to secure the inner glass panel or panels in place.

In accordance with another aspect of the invention, a method for repairing or upgrading insulated glass units in a curtain wall window system is provided, where each of the insulated glass units includes a window assembly comprising inner and outer glass panels spaced apart by a separator to form a hermetically sealed cavity there between, and a window framing housing the window assembly. The method includes breaking or altering the separator to release the inner glass panel from the outer glass panel, with the outer glass panel being retained in place within the window framing. The method also includes applying a new separator to one of the inner glass panel and the outer glass panel and reaffixing the inner glass panel to the outer glass panel such that the new separator maintains a space between the inner glass panel and the outer glass panel to form the hermetically sealed cavity therebetween.

Various other features and advantages of the present invention will be made apparent from the following detailed description and the drawings.

BRIEF DESCRIPTION OF THE DRAWINGS

The drawings illustrate embodiments presently contemplated for carrying out the invention.

In the drawings.

DETAILED DESCRIPTION

Embodiments of the invention are directed to a process of repairing, renewing, or upgrading of a failing hermetically sealed insulated glass unit. The process is performed while keeping the outside glass panel of the unit in place, such that the interior of the building is not exposed to outside elements during performing of the repair/renewal process and a tenant may continue to occupy the space while the process takes place. The insulated glass unit could additionally be upgraded during the process by applying UV and solar heat reducing coatings to the retained panel(s) of glass before the reassembling of the unit, by injecting a heavy gas into the hermetically sealed space between panels in the insulated glass unit, and/or by installing photo cell elements or coatings inside the insulated glass unit that are capable of converting solar energy to electricity.

Embodiments of the invention are described here below with regard to the structure of a two-pane, hermetically sealed insulated glass unit and a process of repairing, renewing, or upgrading such a two-pane insulated glass unit. It is recognized, however, that embodiments of the invention are also meant to include and encompass hermetically sealed insulated glass units constructed as three-pane units and having a third glass panel or elastomeric film included therein. Accordingly, it is understood that the scope of the invention is not to be limited to the structures and associated repairing, renewing, or upgrading processes specifically described herebelow.

Figure 1:
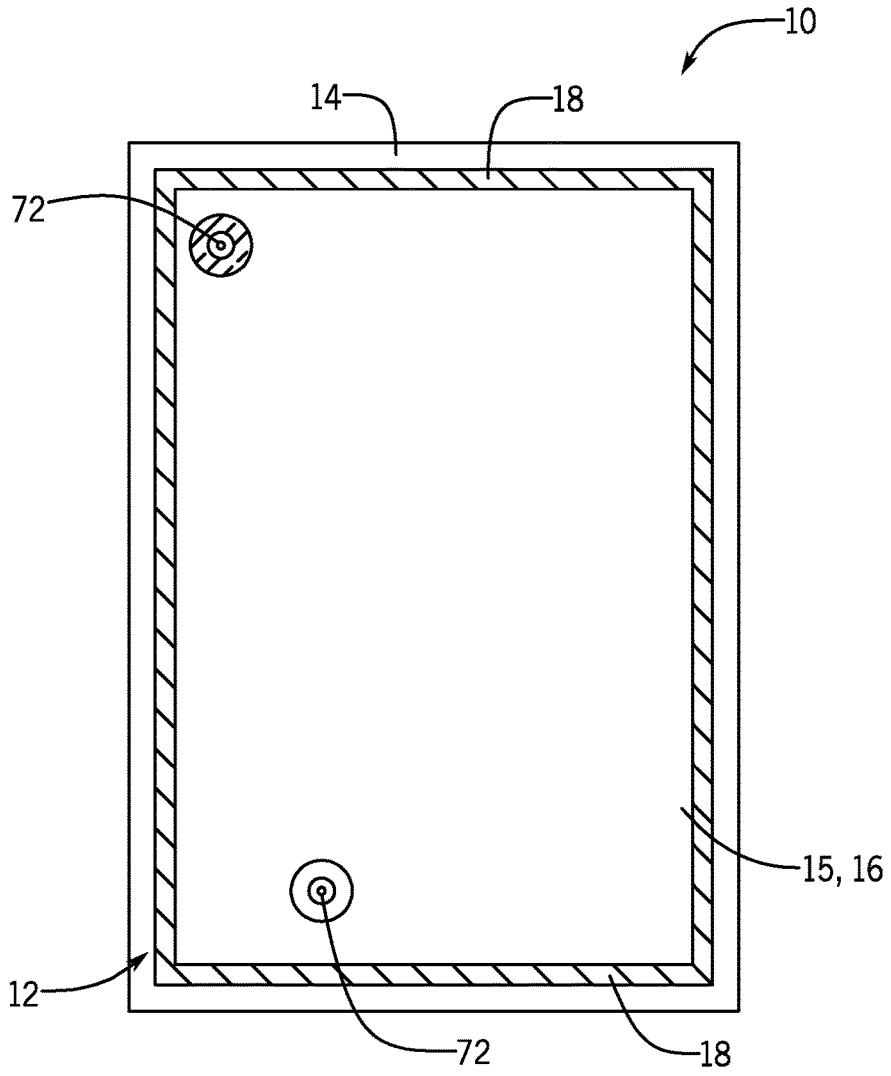
FIG. 1 is a front view of a hermetically sealed insulated glass unit that may be included in a typical curtain wall window system, with the insulated glass unit being held in place by snap-on aluminum extrusions, useable in embodiments of the invention.
Figure 2:
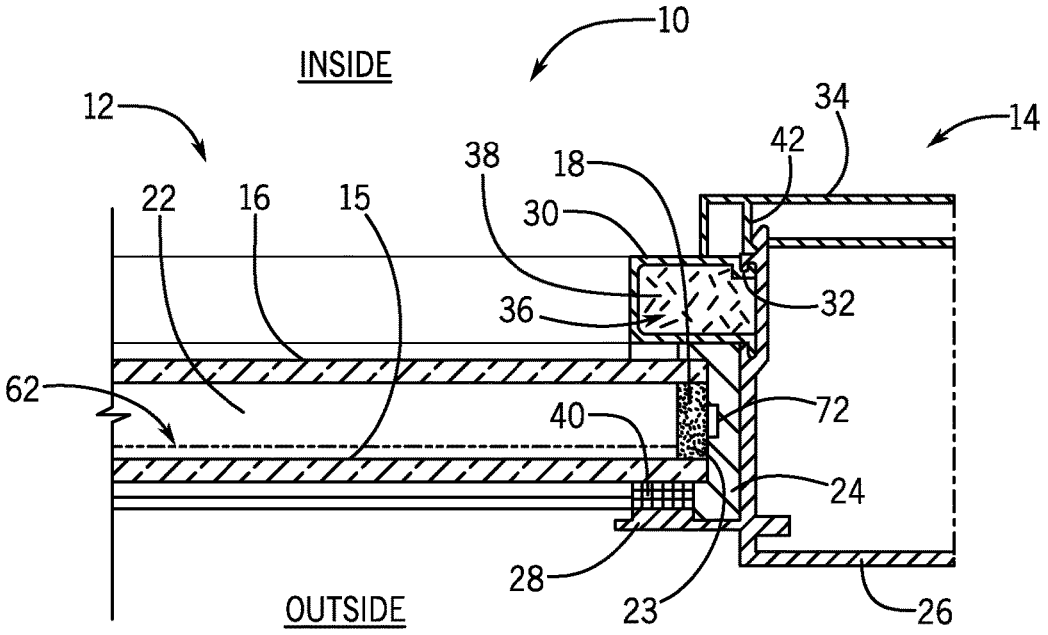
FIG. 2 is a horizontal cross-section of the curtain wall window of FIG. 1.

Referring to FIGS. 1 and 2, an insulated glass unit 10 is illustrated with which embodiments of the invention might be employed. The insulated glass unit 10 includes a window assembly 12 housed within a window framing or curtain wall framing/extrusions 14 (referred to generally hereafter as "window framing"), with the insulated glass units capable of being arranged side-by-side with other identical insulated glass units 10 to form a curtain wall system of windows such as might be found in office or residential high-rise buildings or other similar high-rise structures. The window assembly 12 includes at least first and second spaced apart substantially parallel glass panels 15, 16—which are outside and inside panels 15, 16 in the embodiment of FIGS. 1 and 2, and where "glass" is understood to refer to any suitable material that might be used to form a window panel. The glass panels 15, 16 are interconnected by a peripheral edge spacer or separator 18 that space the panels 15, 16 apart to form a hermetically sealed space or cavity 22 therebetween. According to an exemplary embodiment, the separator 18 is made of anodized aluminum, stainless steel, or elastomeric materials, such as reinforced butyl rubber, along with a sealant that helps form the hermetic seal. The separator 18 also includes therein a desiccant moisture absorbing agent 23 that absorbs moisture. However, it is recognized that other materials could be used to form the separator 18, such a composite of a glass frit and binder material, with materials that could be included in the composite including but not limited to vanadium oxide, barium oxide, zinc oxide, lead oxide, or an alkali silicate (e.g. sodium silicate, potassium silicate, etc.) material. In one embodiment, an adhesive 24 may be applied behind the separator 18 and out around edges of glass substrates panels 15, 16 to strengthen the insulated glass unit 10.

As shown in FIGS. 1 and 2, the window framing 14 is located along and/or around the periphery of the window assembly 12. In particular, the window framing 14 may be made up of one or more parts and is provided along all four peripheral sides of the window assembly 12 (assuming a rectangular shaped window assembly 12). As shown in FIG. 2, each side of window framing 14 is structured to include: a main body 26, an outside glass stop 28 integrally formed with the main body 26, an inside glass stop 30 that may include a clip 32 for selectively connecting/removing the inside glass stop 30 to/from the main body 26, and a removable decorative member 34 secured to main body 26 adjacent inside glass stop 30 to help retain the inside glass stop 30, with the decorative member 34 extending between window framing 14 of adjacent insulated glass units 10 to be secured at both ends thereof. An opening 36 within inside glass stop 30 is filled with an insulating material 38 to improve insulating qualities of the framing 14. Additional voids/cavities defined in the main body 26 may be filled with either air at atmospheric pressure or with expandable foam to improve insulating qualities of the window framing or curtain wall system extrusions 10.

As shown in FIG. 2, stops may be substantially parallel to each other, with the window assembly 12 being held and/or positioned, directly or indirectly, between the stop portions 28, 30. When the insulated glass unit 10 is seated in/on the main body 26 and is engaged with the outside glass stop 28, such as via an adhesive or sealant 40, the inside glass stop 30 is connected to the main body 26, for example, via a clip or snap-on portion 32 thereof—with the stop portions 28, 30 providing lateral support to the window assembly 12. The decorative member 34 is then snapped onto the main body 26 via a clip or snap-on portion 42 thereof, with the decorative member 34 being positioned adjacent inside glass stop 30 to help retain the inside glass stop. According to an exemplary embodiment, each of the main body 26, stop portions 28, 30, and decorative member 34 are formed as aluminum extrusions/components, but it is recognized that the components may be made of any alternative suitable material, including vinyl, PVC, wood, steel or other suitable materials.

It is recognized that insulated glass units such as that shown in FIGS. 1 and 2 may fail over time. That is, the hermetic seal formed by the separator 18 and sealant 24 will eventually fail, such that argon or another gas within the hermetically sealed space/cavity 22 may slowly leak out therefrom to the atmosphere and/or moisture may infiltrate into the space/cavity 22. As previously indicated, the separator 18 contains a desiccant or moisture absorbing agent 23 that absorbs moisture that attempts to penetrate into the cavity 22. However, it is recognized that the moisture absorbing properties of the separator 18 will lessen over time, such that moisture will eventually enter into the cavity during the life time of the insulated glass unit 10 by slowly penetrating (by process of osmosis) into the unit through the adhesive/sealant 24 and separator 18. Also, aging of the adhesive/sealant 24 will cause damage to the hermetic seal and allow the outside moisture to enter in to the cavity of the insulated glass unit 10, causing vision distortion and a so called "milking effect" on the inside of the cavity 22—thus resulting in a failure of the unit that thereby requires replacement.

Accordingly, repair or renewal of the insulated glass unit 10 is thus required. In applications where the insulated glass unit 10 forms part of a curtain wall of windows, such as in a high-rise commercial or residential building, it would be desirable if such repair/renewal could be performed while keeping the outside glass panel 15 of the unit in place, such that the interior of the building is not exposed to outside elements during performing of the repair/renewal process and a tenant may continue to occupy the space while the process takes place.

Figure 3:
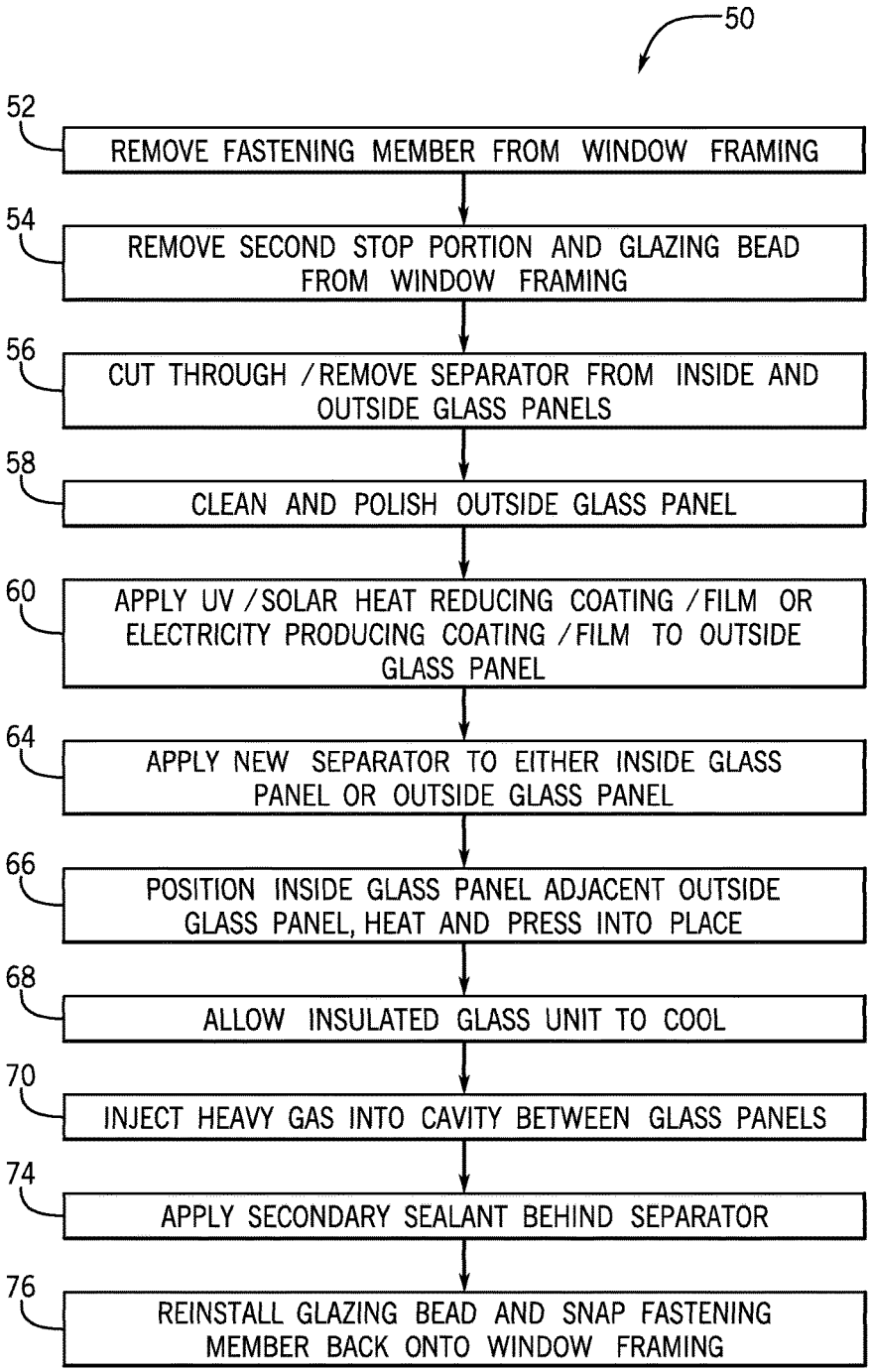
FIG. 3 is a flowchart illustrating a process for repairing, renewing, or upgrading of a failing hermetically sealed insulated glass unit, according to an embodiment of the invention.

In light of the above, exemplary embodiments of the invention are directed to a process for repairing, renewing, or upgrading of a failing hermetically sealed insulated glass unit, with the process being performed while keeping the outside glass panel of the unit in place. Referring now to FIG. 3, a process 50 for repairing, renewing, or upgrading of a failing hermetically sealed insulated glass unit is illustrated according to an embodiment. In describing the process 50, reference is made back to the insulated glass unit 10 of FIGS. 1 and 2 and the structure thereof. However, it is recognized that the process 50 is applicable to repairing, renewing, or upgrading of insulated glass units having a structure other than that specifically shown in FIGS. 1 and 2, with the process 50 being useable generally with any insulated glass unit that generally includes outside and inside glass panels separated by a separator to create an insulating air gap therebetween.

The process 50 begins at STEP 52 by first removing the decorative member 34 from main body 26 of the window framing 14. According to an exemplary embodiment, the removable decorative member 34 may simply be unclipped from the main body 26 via the clip/snap-on feature 42 provided on the member. Upon removal of the decorative member 34, the inside glass stop 30 and the insulating material 38 contained therein are then removed from main body 26 of the window framing 14 at STEP 54. Again, according to an exemplary embodiment, the inside glass stop 30 may simply be unclipped from the main body 26 via the clip/snap-on feature 32 provided on the stop portion.

Upon removal of member and inside glass stop 30 from main body 26, the process 50 continues at STEP 56 by cutting through and removing the separator 18, so as to provide for separation/removal of the inside glass panel and separator 18 from the outside glass panel. According to embodiments, the separator or spacer 18 may be cut through by means of a special cutting knife or tool (powered or manual) or by heating the perimeter of the inside glass panel 16 in order to soften/melt the separator 18 (or an adhesive securing separator to glass panels 15, 16), with it being recognized that the specific technique employed at STEP 56 will be determined (at least in part) by the composition/construction of the separator 18. Upon cutting through and removing the separator 18, the outside glass panel 15 is then cleaned and polished at STEP 58 in order to remove any elements/impurities from the panel that may obstruct vision through the panel and/or subsequently negatively impact performance of the insulated glass unit 10 upon completion of the repair/renewal process 50.

According to one embodiment of the invention, upon cleaning of the outside glass panel 15, an optional step may be performed in process 50 where the outside glass panel 15 is upgraded/enhanced. That is, at STEP 60, a coating or film 62 may be applied to the inward facing surface of the outside glass panel 15 that may be in the form of a UV and solar heat reducing coating/film or a coating/film that converts solar energy to electricity—i.e., solar film or photocell. According to embodiments of the invention, the coating/film 62 may be applied via a spray coating application or as a distinct film. While the coating/film 62 is described above as being applied to the outside glass panel 15, it is recognized that the coating/film could instead be applied to the inside glass panel 16 or suspended in the cavity 22 sandwiched between the panels 15, 16. In each embodiment, the coating/film 62 (whether a UV and solar heat reducing coating/film or a solar power generating coating/film) provides for an upgrading/enhancing of an existing insulated glass unit 10 that may previously have lacked such a coating/film thereon, such that process 50 is not only envisioned as a "repair" process for a failing hermetically sealed insulated glass unit 10, but also as a renewal or upgrading process that can improve the performance of the insulated glass unit 10.

Referring still to FIG. 3, upon an optional application of a coating/film 62 to outside glass panel 15, a new air space separator 18 is applied at STEP 64. According to one embodiment, the separator 18 is applied to the outside glass panel 15 on the inner surface thereof as the outside glass panel 15 is retained in place in window framing 14. In another embodiment, the separator 18 is applied to the inside glass panel 16 that will be attached back onto the outside glass panel 15. According to embodiments, the separator 18 may be composed of a self-adhering material that provides for the separator 18 to attach to the glass panel 15, 16 upon application thereof, or alternatively a separate adhesive may used to apply the separator 18 to the glass panel 15, 16 and adhere the separator 18 thereof. Additionally, the separator 18 contains a moisture absorbing material therein that is part of structural and chemical composition of the separator 18, such that the separator 18 has a moisture absorbing ability that provides for creation of a moisture-free space/cavity 22 between inside and outside glass panels 16, 15 upon completion of the repair/renewal process 50.

Upon application/formation of the separator 18 on either the outside glass panel 15 or the inside glass panel 16, the inside glass panel 16 is put back in position adjacent the outside glass panel 15 and pressed in the direction of the outside glass panel 15 at STEP 66. To seal the inside glass panel 16 to the outside glass panel 15 and form a hermetic seal in the space/cavity 22 therebetween, the separator 18 may be heated at STEP 66 to form an air-tight seal—with it being recognized that there are a number of different adhesives or heating methods which may be utilized to form a hermetic seal, depending on preference. That is, some adhesives do not require heating to form a hermetic seal between the separator or spacer 18 and the glass panels 15, 16, while other adhesives do require heating. If the utilized adhesive requires heat application, such heating may be provided by the separator 18 containing in it a self-heating element or acting by itself as a heating element activated chemically, or by other sources of outside supplied energy in order to create sufficient heat to activate adhesives in/on the separator 18 and form the hermetic seal. When the adhesive, separator 18, and perimeters of both inside and outside glass panels 16, 15 are heated to a sufficient temperature (with the temperature depending on the type of sealing material utilized in order to create a hermetic seal), the inside and outside glass panels 16, 15 are securely joined together. Upon such joining, any external source of energy used to heat the separate/adhesive 18 is disconnected or cutoff and the separator 18 and other components of insulated glass unit 10 are allowed to cool at STEP 68.

According to one embodiment, upon securing of the inside glass panel 16 to outside glass panel 15 via separator 18 at STEP 66 and after allowing cooling of the insulated glass unit 10 to the surrounding room temperature at STEP 68, an optional step may be performed in process 50 where a heavy gas is injected into space between the panels 15, 16 under pressure to replace the air trapped inside space. That is, at STEP 70, a heavy gas such as Argon or similar heavy gas that will not negatively influence the separator 18/adhesive or its moisture absorbing ability is introduced into the space/cavity 22 between the outside and inside glass panels 15, 16 to enhance the thermo-insulting performance of the insulated glass unit 10. The heavy gas is added via a valve system 72 provided/formed in the insulated glass unit 10. According to one embodiment, a gas replacing valve or valves 72 may be installed into the inside glass panel 16 before reassembly of the unit to provide for injection of a heavy gas into space/cavity 22, as shown in FIG. 1. According to another embodiment, a gas replacing valve or valves 72 may be formed into separator 18 to provide for injection of a heavy gas into space/cavity 22, as shown in FIG. 2.

Upon completion of STEP 68 and optional STEP 70, the process 50 continues at STEP 74 by applying a secondary sealant 24 behind the separator 18 and about edges of the inside and outside glass panels 16, 15 to strengthen the insulated glass unit 10. After finishing the application of a secondary sealant or sealants 24, an insulating material 38 is then reinstalled and the removable decorative member 34 (e.g., aluminum extrusion) is snapped back in place on main body 26 at STEP 76. The insulated glass unit 10 may thus be completely reassembled in such a manner without having to ever remove outside glass panel 15.

With regard to the process 50 illustrated and described in FIG. 3, it is recognized that the process 50 may be utilized to repair, renew, or upgrade three-pane or other multi-pane, hermetically sealed insulated glass units 10. In such processes, steps of removing, cleaning and reattaching additional glass panels and associated separators 18 would be performed similar to the steps described above. Accordingly, it is understood that the process 50 is not to be limited solely to two-pane insulated glass units, but that the process 50 should be understood to also cover the repair, renewal, or upgrading of three-pane insulated glass units and other multi-pane insulated glass units.

Beneficially, embodiments of the invention are thus directed to methods and systems of repairing, renewing, or upgrading existing insulated glass units, already installed in a building structure, where hermetic seal failure occurs and moisture penetrates between two or more panels of glass, which had been previously hermetically sealed. In performing the method, an outer panel of the existing unit is retained in the framing (so as to not expose the interior of the building to outside elements) while the inside facing panel or panels will be removed altogether along with the spacer or separator elements. New separators and the old/reused or new inner panel of glass are reinstalled after cleaning and improvements/upgrades are complete, such as application of UV and solar heat reducing coatings to the retained panel(s) of glass prior to reassembling of the unit. Furthermore, the heat insulating performance could be enhanced to the performance equivalent to that of a three-ply insulting glass unit by filling up the re-assembled unit with a heavy gas like Argon or other similar gas fill. Embodiments of the invention thus make it possible to continuously "revitalize" and "upgrade the performance" of existing insulated glass units for the entire useful life cycle of the building structure.

Therefore, according to one embodiment of the invention, a method for repairing or upgrading a failing or insufficiently performing insulated glass unit comprising an inner glass panel or panels and an outer glass panel spaced apart by a separator or separators and being housed within a window framing or curtain wall system is provided. The method includes removing an inside glass stop from the window framing or curtain wall to provide access to the inner glass panel or panels and detaching the inner glass panel or panels from the outer glass panel via a breaking, cutting, or altering of the separator or separators, with the outer glass panel being retained in place within the window framing or curtain wall. The method also includes applying a new separator or separators to one of the inner glass panel or panels or the outer glass panel and reaffixing the inner glass panel or panels to the outer glass panel, with the new separator or separators maintaining a space or spaces between the inner glass panel or panels and the outer glass panel to form a hermetically sealed cavity or cavities there between. The method further includes reinstalling in place the inside glass stop back onto the window framing, to secure the inner glass panel or panels in place.

According to another embodiment of the invention, a method for repairing or upgrading insulated glass units in a curtain wall window system is provided, where each of the insulated glass units includes a window assembly comprising inner and outer glass panels spaced apart by a separator to form a hermetically sealed cavity there between, and a window framing housing the window assembly. The method includes breaking or altering the separator to release the inner glass panel from the outer glass panel, with the outer glass panel being retained in place within the window framing. The method also includes applying a new separator to one of the inner glass panel and the outer glass panel and reaffixing the inner glass panel to the outer glass panel such that the new separator maintains a space between the inner glass panel and the outer glass panel to form the hermetically sealed cavity therebetween.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method for repairing or upgrading a failing or insufficiently performing insulated glass unit comprising an inner glass panel or panels and an outer glass panel spaced apart by a separator or separators and being housed within a window framing or curtain wall system, the method comprising:

removing an inside glass stop from the window framing or curtain wall to provide access to the inner glass panel or panels;

detaching the inner glass panel or panels from the outer glass panel via a breaking, cutting, or altering of the separator or separators, with the outer glass panel being retained in place within the window framing or curtain wall;

applying a new separator or separators to one of the inner glass panel or panels or the outer glass panel;

reaffixing the inner glass panel or panels to the outer glass panel, with the new separator or separators maintaining a space or spaces between the inner glass panel or panels and the outer glass panel to form a hermetically sealed cavity or cavities there between; and reinstalling in place the inside glass stop back onto the window framing, to secure the inner glass panel or panels in place.

2. The method of claim 1 wherein the inside glass stop comprises a clip or snap-on feature that provides for selective attaching and detaching of the inside glass stop from the main body of the window framing or curtain wall.

3. The method of claim 2 wherein reinstalling the inside glass stop back into the window framing comprises:

reattaching the inside glass stop to the main body of the window framing or curtain wall via the clip or snap-on feature; and filling an opening in the inside glass stop with an insulating material.

4. The method of claim 1 wherein detaching the inner glass panel or panels from the outer glass panel comprises cutting through the separator or separators with a cutting tool.

5. The method of claim 1 wherein detaching the inner glass panel or panels from the outer glass panel comprises heating a perimeter of the inner glass panel or panels in order to soften or melt the separator or separators and thereby release the inner glass panel or panels from the outer glass panel.

6. The method of claim 1 further comprising cleaning and/or polishing the outer glass panel upon detaching of the inner glass panel or panels therefrom.

7. The method of claim 1 further comprising applying a coating or film to one or more of the outer glass panel, the inner panel or panels, or suspended between the inner glass panel or panels and the outer glass panel, upon detaching of the inner glass panel or panels from the outer glass panel, the coating or film comprising one or more of an ultraviolet (UV) reducing coating or film, a solar heat reducing coating or film, or photo cell elements that convert solar energy to electricity.

8. The method of claim 1 wherein reaffixing the inner glass panel or panels to the outer glass panel comprises:

positioning the inner glass panel or panels adjacent to the outer glass panel, with the new separator or separators attached to one of the inner glass panel or panels and the outer glass panel;

heating the separator or separators, an adhesive adjacent the separator or separators, and/or the inner and outer glass panels; and pressing the inner glass panel or panels toward the outer glass panel to seal the inner glass panel or panels to the outer glass panel via the separator or separators;

wherein the separator or separators form a hermetic seal in the space or spaces between the inner glass panel or panels and the outer glass panel.

9. The method of claim 8 further comprising allowing the separator or separators to cool subsequent to reaffixing of the inner glass panel or panels to the outer glass panel and prior to reinstalling the inside glass stop back onto the window framing or curtain wall.

10. The method of claim 1 further comprising injecting a heavy gas into the hermetically sealed cavity or cavities between the inner glass panel or panels and the outer glass panel.

11. The method of claim 10 further comprising installing one or more gas replacing valves into the inner glass panel or panels and/or the separator or separators to provide for injecting of the heavy gas into the cavity or cavities.

12. The method of claim 1 further comprising applying a secondary sealant behind the separator or separators and about edges of the inner and outer glass panels to strengthen the insulated glass unit.

13. The method of claim 1 further comprising:

removing a decorative member from a main body of the window framing or curtain wall prior to removing the inside glass stop; and reattaching the decorative member to the main body of the window framing or curtain wall upon reattaching the inside glass stop.

14. A method for repairing or upgrading older or insufficiently performing insulated glass units in a curtain wall window system, where each of the insulated glass units includes a window assembly comprising inner and outer glass panels spaced apart by a separator to form a hermetically sealed cavity there between, and a window framing housing the window assembly, the method comprising:

breaking or altering the separator to release the inner glass panel from the outer glass panel, with the outer glass panel being retained in place within the window framing;

applying a new separator to one of the inner glass panel and the outer glass panel; and reaffixing the inner glass panel to the outer glass panel such that the new separator maintains a space between the inner glass panel and the outer glass panel to form the hermetically sealed cavity therebetween.

15. The method of claim 14 wherein the window framing comprises a main body having outside and inside glass stops and a decorative member attached thereto, and wherein the method further comprises removing the inside glass stop and the decorative member from the main body to provide access to the inner glass panel and the separator, the decorative member and the inside glass stop being selectively attachable and detachable from the main body.

16. The method of claim 14 further comprising:

reattaching the inside glass stop to the main body upon reaffixing of the inner glass panel to the outer glass panel;

filling an opening in the inside glass stop with insulation; and reattaching the decorative member to the main body to secure the inside glass stop in place.

17. The method of claim 14 wherein breaking or altering the separator comprises one or more of:

cutting through the separator with a cutting tool; and heating a perimeter of the inner glass panel in order to soften or melt the separator and thereby release the inner glass panel from the outer glass panel.

18. The method of claim 14 further comprising applying a coating or film to one or more of the outer glass panel, the inner glass panel, or suspended between the inner and outer glass panels, upon detaching of the inner glass panel from the outer glass panel, the coating or film comprising one or more of an ultraviolet (UV) reducing coating or film, a solar heat reducing coating or film, or photo cell elements that convert solar energy to electricity.

19. The method of claim 14 wherein reaffixing the inner glass panel to the outer glass panel comprising:

positioning the inner glass panel adjacent to the outer glass panel, with the new separator attached to one of the inner glass panel and the outer glass panel;

heating the separator, an adhesive adjacent the separator, and/or the inner and outer glass panels; and pressing the inner glass panel toward the outer glass panel to seal the inner glass panel to the outer glass panel via the separator;

wherein the separator forms the hermetic sealed cavity between the inner glass panel and the outer glass panel.

20. The method of claim 14 further comprising injecting a heavy gas into the hermetically sealed cavity between the inner glass panel and the outer glass panel, the heavy gas being injected via gas replacing valves formed in the inner glass panel and/or in the separator.

* * * * *